US008056997B2

(12) United States Patent
Baek

(10) Patent No.: US 8,056,997 B2
(45) Date of Patent: Nov. 15, 2011

(54) RESERVING APPARATUS OF REFRIGERATOR

(75) Inventor: Seung-Jo Baek, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 279 days.

(21) Appl. No.: 12/447,610

(22) PCT Filed: Oct. 30, 2007

(86) PCT No.: PCT/KR2007/005392

§ 371 (c)(1),
(2), (4) Date: Apr. 28, 2009

(87) PCT Pub. No.: WO2008/054116

PCT Pub. Date: May 8, 2008

(65) Prior Publication Data

US 2010/0050683 A1 Mar. 4, 2010

(30) Foreign Application Priority Data

Oct. 30, 2006 (KR) ..... 10-2006-0105810

(51) Int. Cl.
*A47B 96/04* (2006.01)

(52) U.S. Cl. ..... 312/405.1; 312/408; 211/81

(58) Field of Classification Search ..... 312/321.5, 312/405.1, 408, 322, 323, 333; 108/193, 108/157.18, 8; 248/240, 240.3; 211/80, 211/81

See application file for complete search history.

(56) References Cited

U.S. PATENT DOCUMENTS

| | | | | | |
|---|---|---|---|---|---|
| 1,115,345 | A | * | 10/1914 | Steuernagel | 312/109 |
| 2,062,360 | A | * | 12/1936 | Goulooze | 312/275 |
| 2,749,718 | A | * | 6/1956 | Saunders | 62/377 |
| 4,333,588 | A | * | 6/1982 | Schreck et al. | 222/164 |
| 6,695,165 | B2 | * | 2/2004 | Park | 220/812 |

FOREIGN PATENT DOCUMENTS

| | | | |
|---|---|---|---|
| KR | 10-2005-0051324 | A | 6/2005 |
| KR | 10-2006-0015146 | A | 2/2006 |
| KR | 10-2006-0068751 | A | 6/2006 |

* cited by examiner

*Primary Examiner* — Korie Chan
(74) *Attorney, Agent, or Firm* — Birch, Stewart, Kolasch & Birch, LLP

(57) ABSTRACT

A reserving apparatus of a refrigerator having a door and a case that forms a main reserving chamber therein, comprises: a supplementary reserving frame that forms a supplementary reserving chamber at the door separately from the main reserving chamber; a partition member coupled to the supplementary reserving frame, for partitioning the supplementary reserving chamber; and a connecting portion for connecting the partition member to the supplementary reserving frame so that a partitioned space inside the supplementary reserving chamber can be variable. Storage items having various sizes and forms, such as a storage items having a relatively large size and a storage items having a relatively small size, can be effectively reserved at a suitably-adjusted space inside the supplementary reserving chamber. Accordingly, the supplementary reserving chamber can have enhanced spatial utilization degree.

14 Claims, 11 Drawing Sheets

[Fig. 1]
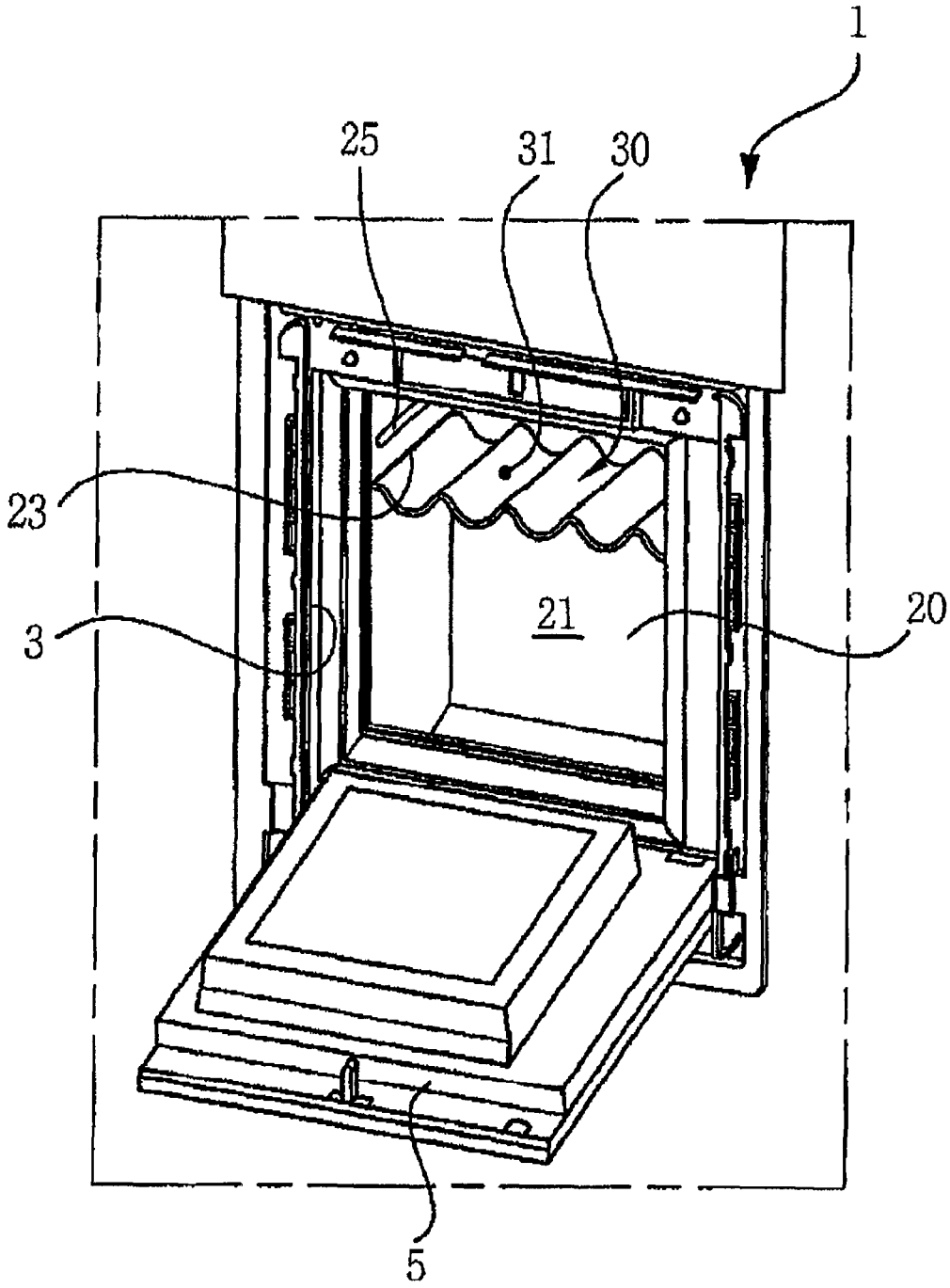

[Fig. 2]
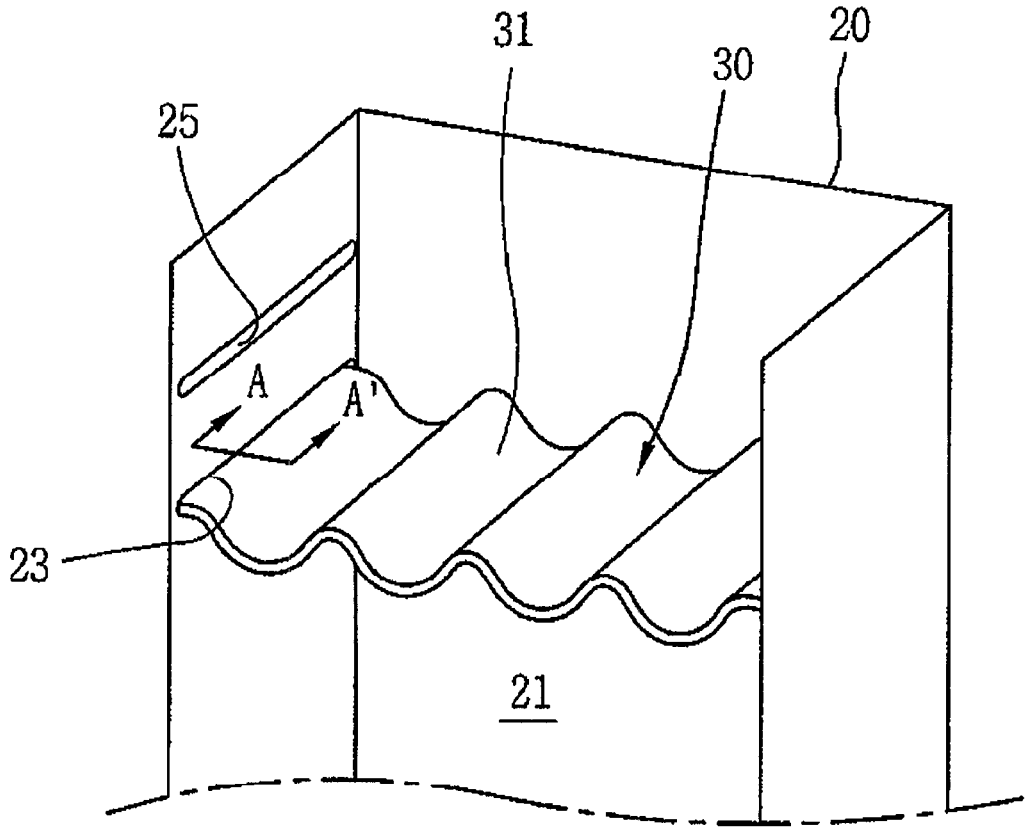

[Fig. 3]
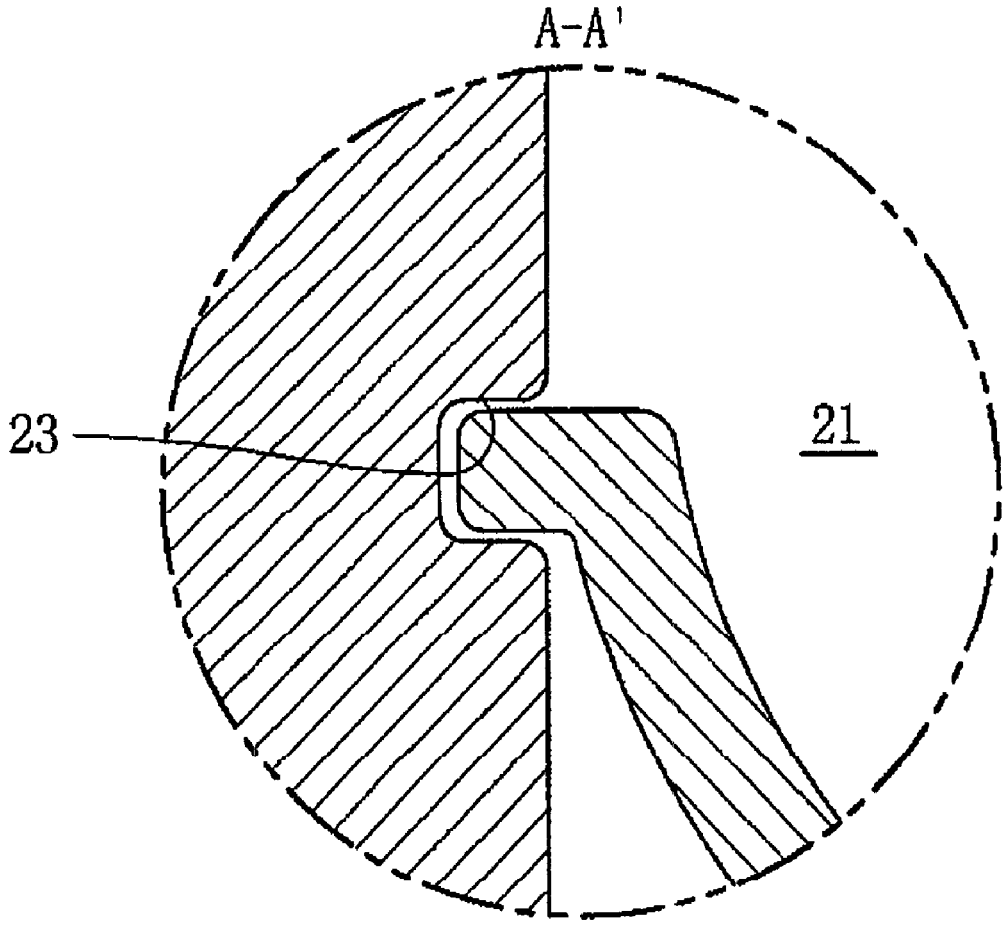

[Fig. 4]
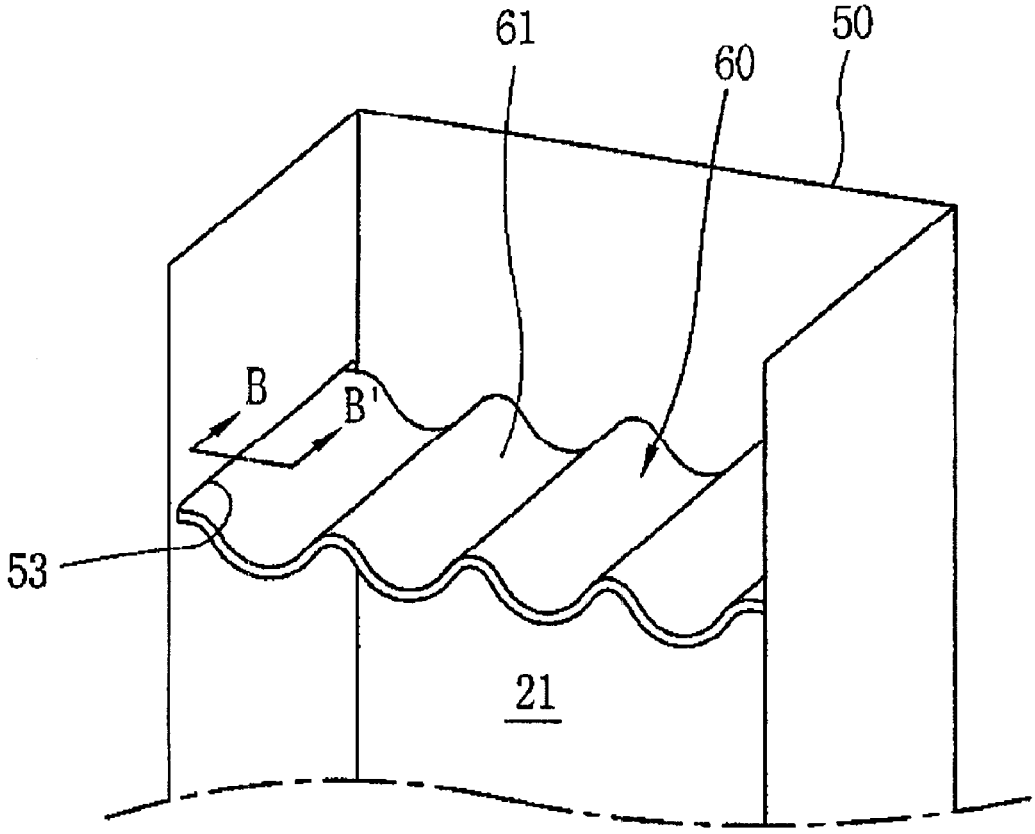

[Fig. 5]
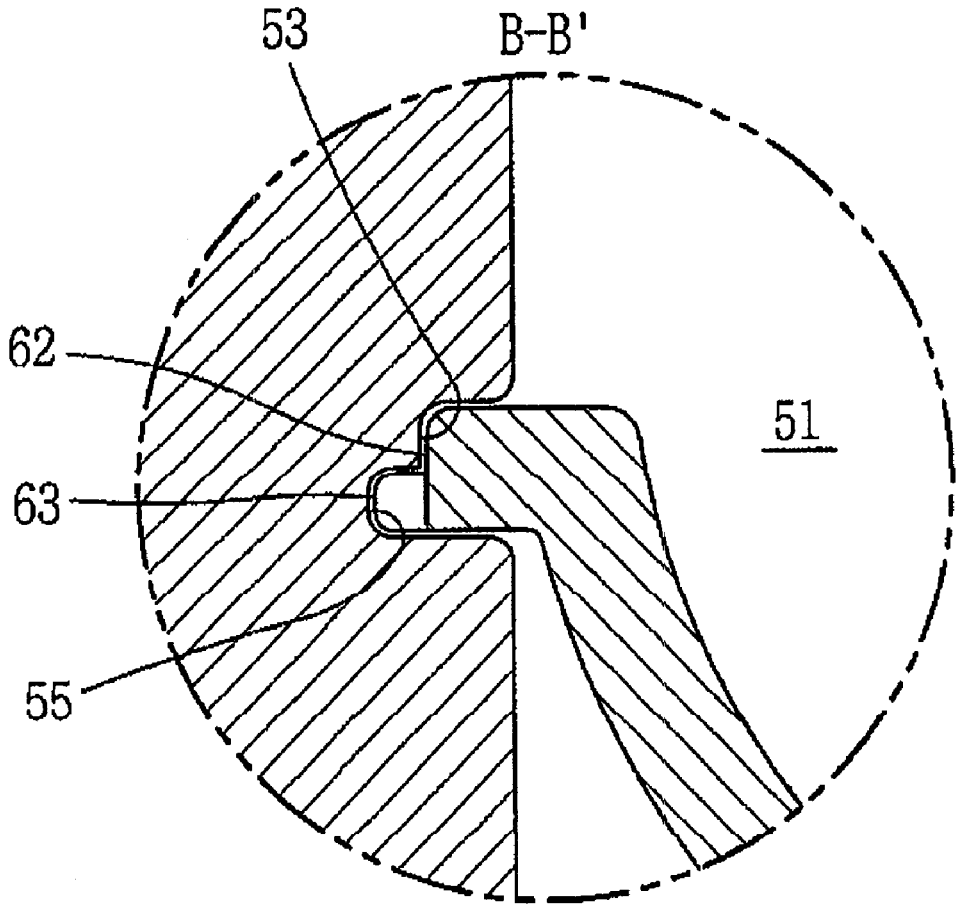

[Fig. 6]
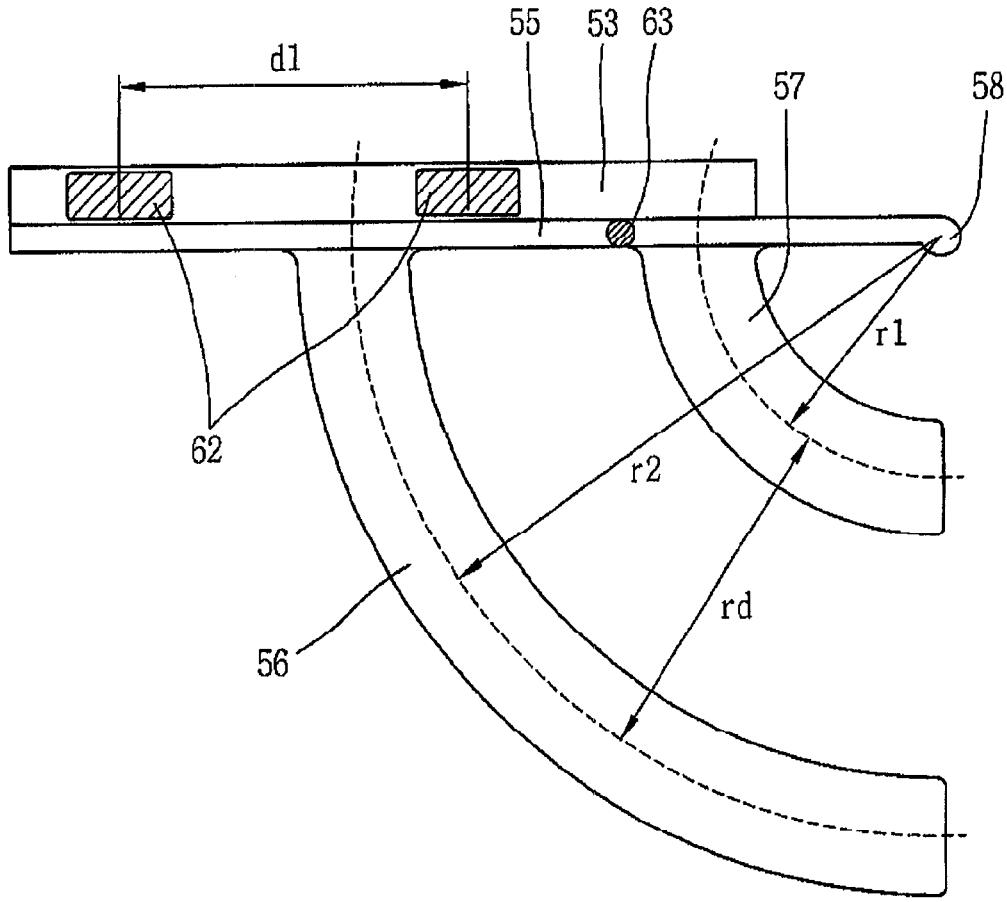

[Fig. 7]
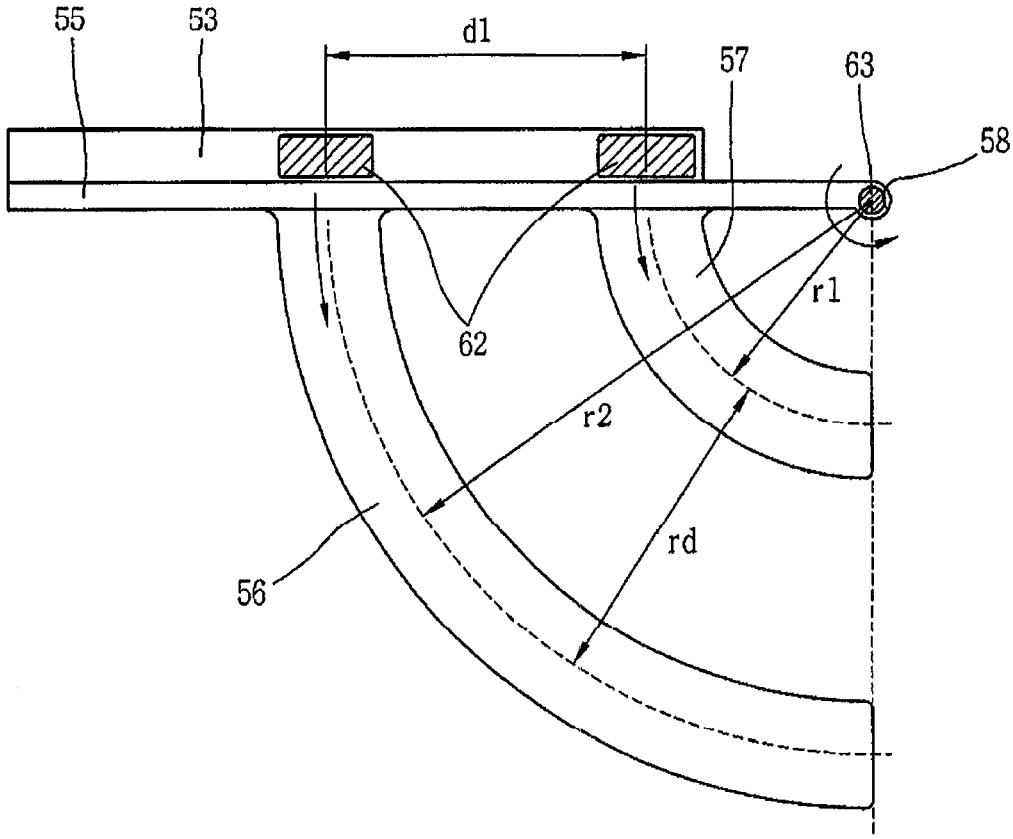

[Fig. 8]
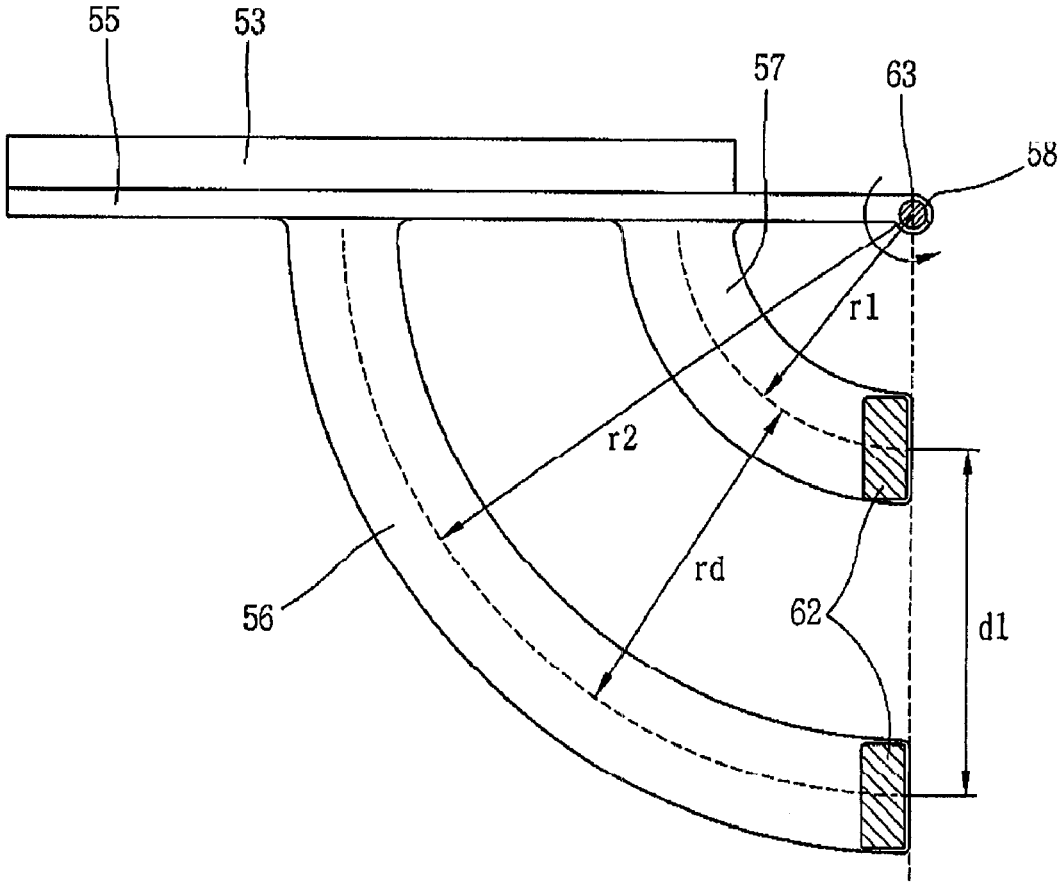

[Fig. 9]
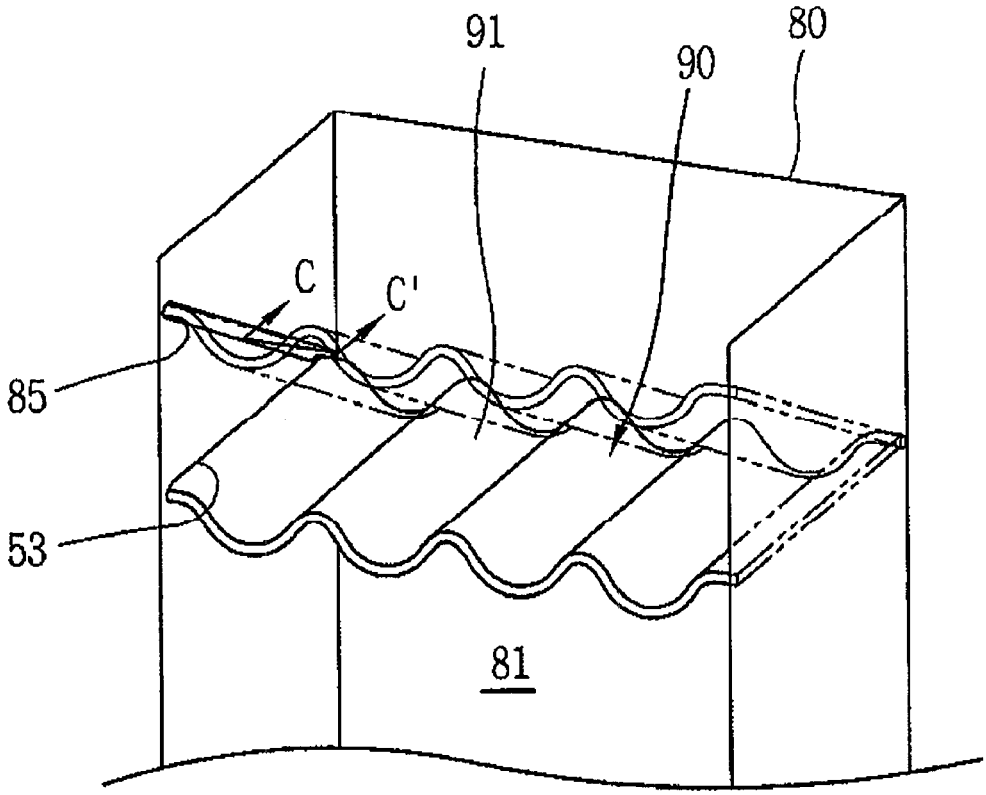

[Fig. 10]
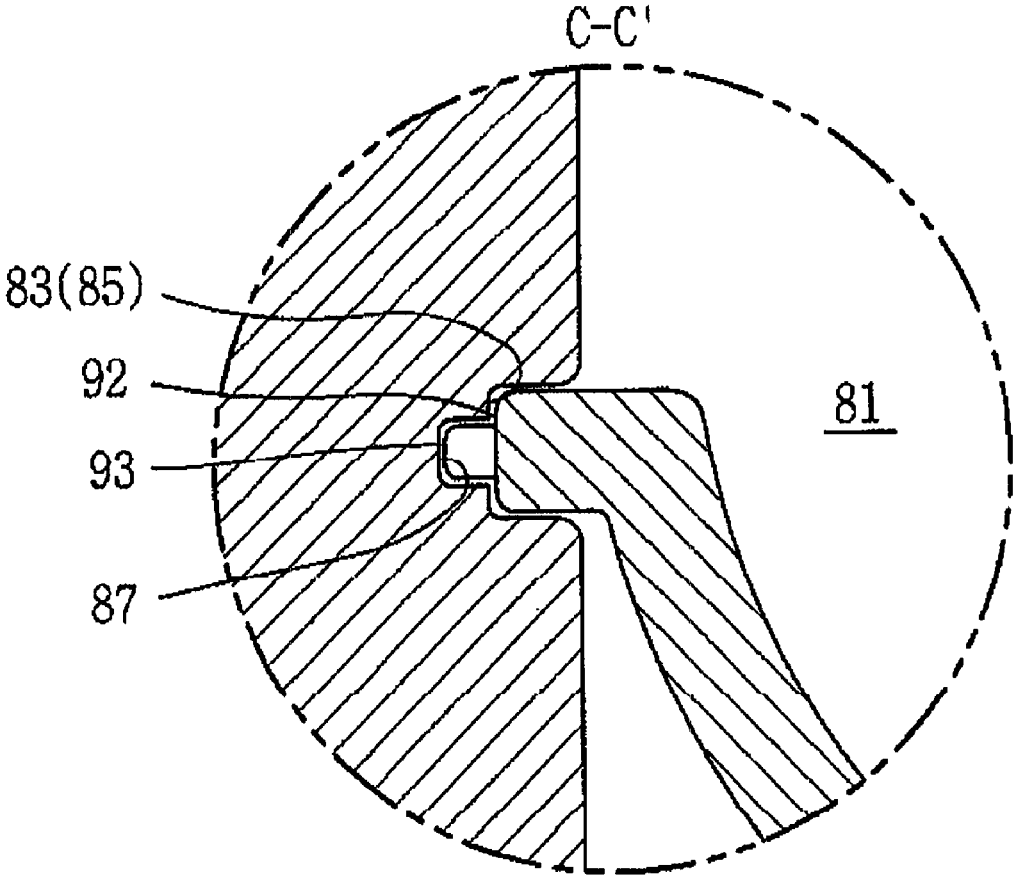

[Fig. 11]
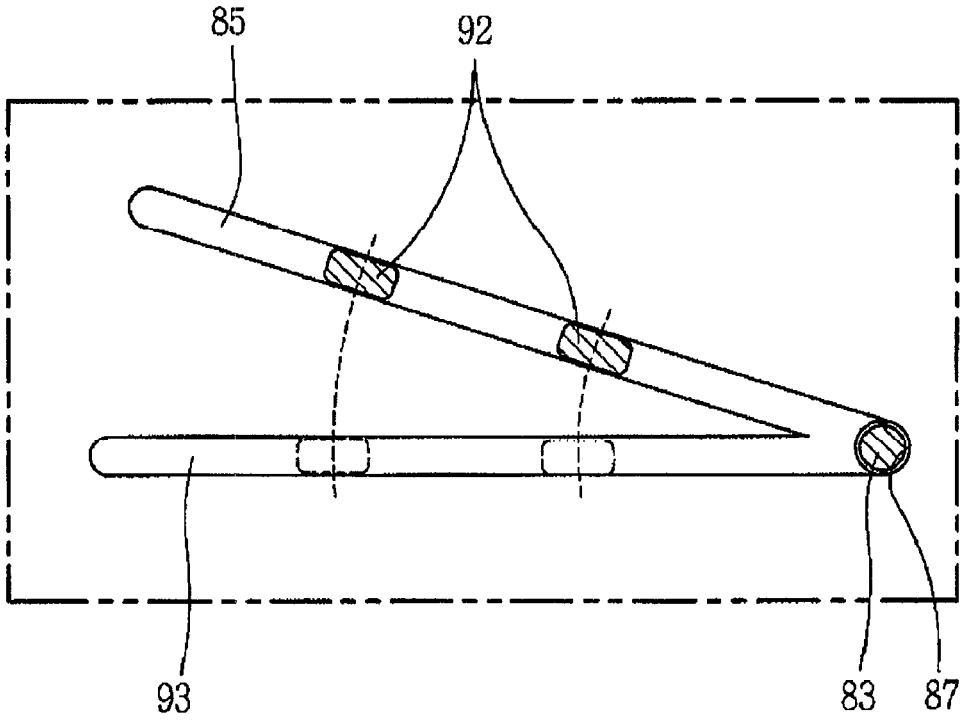

RESERVING APPARATUS OF REFRIGERATOR

TECHNICAL FIELD

The present invention relates to a refrigerator, and more particularly, to a reserving apparatus of a refrigerator.

BACKGROUND ART

A refrigerator serves to store food items accommodated in a reserving space such as a freezing chamber and a refrigerating chamber in a fresh state by using a refrigerating cycle.

The reserving space of the refrigerator is divided into a main reserving chamber which is a hermetic space formed by a case and a door, and a supplementary reserving chamber formed at the door separately from the main reserving chamber.

The supplementary reserving chamber is a space formed by a supplementary reserving frame. A partition member for partitioning inside of the supplementary reserving chamber with a multi-stage may be installed at the supplementary reserving frame.

Generally, small items such as a beverage can is disposed on an upper surface of the partition member. As the inside of the supplementary reserving chamber is partitioned into a multi-stage, spatial utilization degree of the supplementary reserving chamber may be enhanced.

However, in the conventional refrigerator, the partition member is fixed to a certain height of the supplementary reserving frame. Accordingly, the size of the supplementary reserving chamber partitioned by the partition member is always maintained to be same. As a result, the size of the supplementary reserving chamber partitioned by the partition member is not suitable for a storage item having a relatively small size or a storage item having a relatively large size. Accordingly, spatial utilization degree of the supplementary reserving chamber may be degraded.

DISCLOSURE OF THE INVENTION

Therefore, it is an object of the present invention to provide a reserving apparatus of a refrigerator capable of varying a partitioned space inside a supplementary reserving chamber.

In a first aspect of the present invention, there is provided a reserving apparatus of a refrigerator having a door and a case that forms a main reserving chamber therein, comprising: a supplementary reserving frame that forms a supplementary reserving chamber at the door separately from the main reserving chamber; a partition member coupled to the supplementary reserving frame, for partitioning the supplementary reserving chamber; and a connecting portion for connecting the partition member to the supplementary reserving frame so that a partitioned space of the supplementary reserving chamber can be variable.

In a second aspect of the present invention, there is provided a reserving apparatus of a refrigerator having a door and a case that forms a main reserving chamber therein, comprising: a supplementary reserving frame that forms a supplementary reserving chamber at the door separately from the main reserving chamber, and having two or more slots at different heights; and a partition member having an insertion protrusion inserted into one of the slots installed at different heights, for partitioning the supplementary reserving chamber.

In a third aspect of the present invention, there is provided a reserving apparatus of a refrigerator having a door and a case that forms a main reserving chamber therein, comprising: a supplementary reserving frame that forms a supplementary reserving chamber at the door separately from the main reserving chamber, having a guide protrusion guiding recess of a certain length, and having a rotation protrusion rotating recess of a certain size; and a partition member having a guide protrusion inserted into the guide protrusion guiding recess and movable therealong, having a protrusion inserted into the rotation protrusion rotating recess and rotatable therein, and configured to have a variable posture in the supplementary reserving chamber.

In a fourth aspect of the present invention, there is provided a reserving apparatus of a refrigerator having a door and a case that forms a main reserving chamber therein, comprising: a supplementary reserving frame that forms a supplementary reserving chamber at the door separately from the main reserving chamber, having a base recess of a certain length, and having an inclination recess inclined with respect to the base recess; and a partition member and configured to have a variable posture in the supplementary reserving chamber, and having a recess coupling protrusion coupled to one of the base recess and the inclination recess, for partitioning the supplementary reserving chamber.

In a fifth aspect of the present invention, there is provided a reserving apparatus of a refrigerator having a door and a case that forms a main reserving chamber therein, comprising: a supplementary reserving frame that forms a supplementary reserving chamber at the door separately from the main reserving chamber; and a partition member configured to have a variable position or posture in the supplementary reserving chamber, for partitioning the supplementary reserving chamber.

BRIEF DESCRIPTION OF THE DRAWINGS

FIG. 1 is a perspective view showing a part of a refrigerator to which a reserving apparatus of a refrigerator according to a first embodiment of the present invention is applied;

FIG. 2 is a perspective view schematically showing the reserving apparatus of a refrigerator according to a first embodiment of the present invention;

FIG. 3 is a sectional view taken along line 'A-A' in FIG. 2;

FIG. 4 is a perspective view schematically showing a reserving apparatus of a refrigerator according to a second embodiment of the present invention;

FIG. 5 is a sectional view taken along line 'B-B' in FIG. 4;

FIG. 6 is a view of the reserving apparatus of a refrigerator according to a second embodiment of the present invention, which shows a state before a guide protrusion is moved;

FIG. 7 is a view of the reserving apparatus of a refrigerator according to a second embodiment of the present invention, which shows a state after the guide protrusion of FIG. 6 is moved along a guide protrusion guiding recess;

FIG. 8 is a view of the reserving apparatus of a refrigerator according to a second embodiment of the present invention, which shows the guide protrusion of FIG. 7 being rotated along a guide protrusion rotating recess;

FIG. 9 is a perspective view schematically showing a reserving apparatus of a refrigerator according to a third embodiment of the present invention;

FIG. 10 is a sectional view taken along line 'C-C' in FIG. 9; and

FIG. 11 is a view of a reserving apparatus of a refrigerator according to a third embodiment of the present invention, which shows a recess coupling protrusion is coupled to one of a base recess and an inclination recess.

MODES FOR CARRYING OUT THE PREFERRED EMBODIMENTS

Reference will now be made in detail to the preferred embodiments of the present invention, examples of which are illustrated in the accompanying drawings.

Hereinafter, a reserving apparatus of a refrigerator according to a first embodiment of the present invention will be explained in more detail with reference to the attached drawings.

FIG. 1 is a perspective view showing a part of a refrigerator to which a reserving apparatus of a refrigerator according to a first embodiment of the present invention is applied, FIG. 2 is a perspective view schematically showing the reserving apparatus of a refrigerator according to a first embodiment of the present invention, and FIG. 3 is a sectional view taken along line 'A-A' in FIG. 2.

Referring to FIGS. 1 to 3, the refrigerator 1 to which the reserving apparatus for a refrigerator according to the present invention is applied, having a door and a case that forms a main reserving chamber therein, comprises: a supplementary reserving frame 20 that forms a supplementary reserving chamber 21 at the door separately from the main reserving chamber; and a partition member 30 configured to have a variable position or posture in the supplementary reserving chamber 21, for partitioning an inner space of the supplementary reserving chamber 21.

In another aspect of the present invention, the refrigerator 1 having a door and a case that forms a main reserving chamber therein, comprises: a supplementary reserving frame 20 that forms a supplementary reserving chamber 21 at the door separately from the main reserving chamber; a partition member 30 coupled to the supplementary reserving frame 20, for partitioning the supplementary reserving chamber 21; and a connecting portion for connecting the partition member 30 to the supplementary reserving frame 20 so that a partitioned space inside the supplementary reserving chamber 21 can be variable.

In still another aspect of the present invention, the refrigerator 1 including a door and a case that forms a main reserving chamber therein, comprises: a supplementary reserving frame 20 that forms a supplementary reserving chamber 21 at the door separately from the main reserving chamber, and having two or more slots 23 and 25 at different heights; and a partition member 30 having an insertion protrusion 32 inserted into one of the slots 23 and 25 installed at different heights, for partitioning the supplementary reserving chamber 21.

More specifically, a lower slot 23 is long concaved in back and forth directions at both side surfaces of the supplementary reserving chamber 21. Also, an upper slot 25 is long concaved in back and forth directions at both side surfaces of the supplementary reserving chamber 21, and is disposed above the lower slot 23 with a certain distance therebetween.

One upper slot 25 and one lower slot 23 may be formed at two facing surfaces of the supplementary reserving frame 20 at the same height. The slots may be formed at two facing surfaces of the supplementary reserving frame 20 at the same height in one pair of the upper slots 25 and one pair of the lower slots 23.

The insertion protrusion 32 is formed at both ends of the partition member 30, and may be inserted into one of the upper slot 25 and the lower slot 23.

In the present invention, the lower slot 23 and the upper slot 25 are installed at the supplementary reserving frame 200 with different heights. However, the present invention is not limited to the above configuration. More slots may be formed at different heights of the supplementary reserving frame 200.

A partition member 30 for storing storage items such as a plurality of cans is provided at the supplementary reserving chamber 21. A receiving recess 31 having a semi-circular shape is consecutively formed at the partition member 30 in right and left direction. A can having a cylindrical shape may be mounted at the receiving recess 31.

The partition member 30 is formed to have a certain elastic force in right and left directions. Both side ends of the partition member 30 are insertion-fixed to one of the lower slot 23 and the upper slot 35 according to a size of a storage item to be reserved in the supplementary reserving chamber 21.

That is, a position of the partition member 30 becomes variable according to the size of a storage item to be received in the supplementary reserving chamber 21. In a state that both side ends of the partition member 30 have been inserted into the lower slot 23, when food having a size larger than a height from a lower surface of the supplementary reserving chamber 21 to a lower surface of the partition member 30 is to be received in the supplementary reserving chamber 21, the partition member is upward moved. Accordingly, both side ends of the partition member 30 are inserted into the upper slot 25. Here, the partition member 30 is elastically deformed in right and left directions, thereby easily moving.

The operation of the reserving apparatus of the refrigerator 1 according to the present invention will be explained.

In a state that both side ends of the partition member 30 have been insertion-fixed to the lower slot 23, when food having a size larger than a height from a lower surface of the supplementary reserving chamber 21 to a lower surface of the partition member 30 is to be received in the supplementary reserving chamber 21, the partition member is upward moved.

Here, when the partition member 30 is elastically deformed in right and left directions, both side ends of the partition member 30 are separated from the lower slot 23.

Under this state, if the partition member 30 is continuously moved above the supplementary reserving chamber 21, both side ends of the partition member 30 are insertion-fixed to the upper slot 25. Accordingly, a height of an inlet through which a storage item is introduced into the supplementary reserving chamber 21, that is, a height from a lower surface of the supplementary reserving chamber 21 to a lower surface of the partition member 30, is increased. As a result, food introduced into or taken out of the supplementary reserving chamber 2 is not interfered with the partition member 30, and spatial utilization degree of the supplementary reserving chamber 21 is enhanced.

Another embodiments of the reserving apparatus of a refrigerator according to the present invention will be explained.

The same explanation as the aforementioned one will be omitted.

FIG. 4 is a perspective view schematically showing a reserving apparatus of a refrigerator according to a second embodiment of the present invention; FIG. 5 is a sectional view taken along line 'B-B' in FIG. 4; FIG. 6 is a view of the reserving apparatus of a refrigerator according to a second embodiment of the present invention, which shows a state before a guide protrusion is moved; FIG. 7 is a view of the reserving apparatus of a refrigerator according to a second embodiment of the present invention, which shows a state after the guide protrusion of FIG. 6 is moved along a guide protrusion guiding recess; and FIG. 8 is a view of the reserving apparatus of a refrigerator according to a second embodiment of the present invention, which shows the guide protrusion of FIG. 7 being rotated along a guide protrusion rotating recess.

Referring to FIGS. 4 to 8, according to a second embodiment of the present invention, a reserving apparatus of a refrigerator 1 having a door and a case that forms a main reserving chamber therein, comprises: a supplementary reserving frame 50 that forms a supplementary reserving chamber 51 at the door separately from the main reserving chamber, having a guide protrusion guiding recess 53 of a certain length, and having a rotation protrusion rotating recess 58 of a certain size; and a partition member 60 having a guide protrusion 62 inserted into the guide protrusion guiding recess 53 and movable therealong 53, having a rotation protrusion 63 inserted into the rotation protrusion rotating recess 58 and rotatable therealong 58, and configured to have a variable posture in the supplementary reserving chamber 51, for partitioning an inner space of the supplementary reserving chamber 51.

A guide protrusion rotating recess 57 for rotating the guide protrusion 62 is formed at the supplementary reserving frame 50 so as to be communicated with the guide protrusion guiding recess 53.

When the rotation protrusion 63 is rotated in the rotation protrusion rotating recess 58, the guide protrusion 62 is also rotated in the guide protrusion rotating recess 57 by interacting with the rotation protrusion 63.

For smooth rotation of the rotation protrusion 63 and the guide protrusion 62, the guide protrusion rotating recesses 56 and 57 may be formed on each circumference having diameters (r1 and r2) formed by making the rotation protrusion rotating recess 58 as a center.

At least two guide protrusions 62 may be formed, and the number of the guide protrusion guiding recesses 53 may be less than that of the guide protrusions 62 by at least one. Also, the number of the guide protrusion rotating recesses 57 may correspond to that of the guide protrusions 62.

A distance (d1) between the two or more guide protrusions 62 may be equal to a distance (rd) between the guide protrusion rotating recesses 57 having the same number as the guide protrusions 62.

Under the above configuration, an entire structure is simplified, and the guide protrusion 62 can be smoothly operated.

The guide protrusion guiding recess 53 may be formed to be horizontal with respect to the supplementary reserving frame 50. Also, an end of the guide protrusion rotating recess 57 may be formed to be vertical with respect to the guide protrusion guiding recess 53.

When the guide protrusion 62 is disposed in the guide protrusion guiding recess 53, the partition member 60 may serve to horizontally partition an inner space of the supplementary reserving chamber 51. Also, when the guide protrusion 62 is rotated along the guide protrusion rotating recess 57, the partition member 60 may be adhered to the supplementary reserving frame 50. Accordingly, the inner space of the supplementary reserving chamber 51 can be effectively utilized according to a size of a storage item to be received in the supplementary reserving chamber 51.

A rotation protrusion guiding recess 55 for guiding motion of the rotation protrusion 63 may be formed at the supplementary reserving frame 50 so as to be communicated with the rotation protrusion rotating recess 57.

Once the guide protrusion 62 is moved in the guide protrusion guiding recess 53, the rotation protrusion 63 can be also moved in the rotation protrusion guiding recess 55 by interacting with the guide protrusion 62.

The operation of the reserving apparatus of the refrigerator 1 according to the second embodiment of the present invention will be explained.

Referring to FIG. 6, when the guide protrusion 62 is disposed in the guide protrusion guiding recess 53, the partition member 60 horizontally partitions the supplementary reserving chamber 51. Here, the rotation protrusion 63 is disposed in the rotation protrusion guiding recess 55.

Then, the guide protrusion 62 is backward moved along the guide protrusion guiding recess 53 by an external force, the partition member 60 is moved to a rear side of the supplementary reserving chamber 51 with horizontally partitioning the supplementary reserving chamber 51. Here, the rotation protrusion 63 is together moved along the rotation protrusion guiding recess 55 by interacting with motion of the guide protrusion 62.

Referring to FIG. 7, when being moved to the guide protrusion rotating recess 57, the guide protrusion 62 is moved along the guide protrusion rotating recess 57. Here, the rotation protrusion 63 is disposed in the rotation protrusion rotating recess 58, and is together rotated therein 58 by interacting with rotation of the guide protrusion 62. Accordingly, the partition member 60 is rotated with making the rotation protrusion 63 as a rotation shaft.

Referring to FIG. 8, when being moved to an end of the guide protrusion rotating recess 57, the rotation of the guide protrusion 62 is stopped. Accordingly, the rotation of the rotation protrusion 63 is stopped.

Under a rotation operation, when the partition member 60 is adhered to the supplementary reserving frame 50, a lower surface thereof comes in contact with the supplementary reserving frame 50. Accordingly, the supplementary reserving chamber 51 forms one space having a relatively large size, not a plurality of partitioned spaces.

FIG. 9 is a perspective view schematically showing a reserving apparatus of a refrigerator according to a third embodiment of the present invention; FIG. 10 is a sectional view taken along line 'C-C' in FIG. 9; and FIG. 11 is a view of a reserving apparatus of a refrigerator according to a third embodiment of the present invention, which shows a recess coupling protrusion is coupled to one of a base recess and an inclination recess.

Referring to FIGS. 9 to 11, according to a third embodiment of the present invention, a reserving apparatus of a refrigerator 1 having a door and a case that forms a main reserving chamber therein, comprises: a supplementary reserving frame 80 that forms a supplementary reserving chamber 81 at the door separately from the main reserving chamber, having a base recess 83 of a certain length, and having an inclination recess 85 inclined with respect to the base recess 83; and a partition member 90 having a recess coupling protrusion 92 coupled to one of the base recess 83 and the inclination recess 85, and configured to have a variable posture in the supplementary reserving chamber 81, for partitioning the supplementary reserving chamber 81.

The base recess 83 and the inclination recess 85 may have one or more common regions formed by coming in contact with other. A rotation protrusion 93 may be formed at the partition member 90, and a rotating recess 87 for rotating the rotation protrusion 93 inserted thereinto may be formed at the common region.

The common region may be formed at each one end of the base recess 83 and the inclination recess 85.

As the recess coupling protrusion 92 is coupled to one of the base recess 83 and the inclination recess 85, the partition ember 90 may partition the inside of the supplementary reserving chamber 81 in a horizontal manner or in an inclined manner.

Under the variable partitioning structure, as the rotation protrusion 93 inserted into the rotating recess 87 is rotated in the rotating recess 87, the recess coupling protrusion 92 can be smoothly moved with respect to the base recess 83 and the inclination recess 85.

The inclination recess 85 may be formed so that a front side thereof based on back and forth directions of the supplementary reserving frame 80 can be higher than a rear side thereof. Accordingly, when the recess coupling protrusion 92 is coupled to the inclination recess 85, a storage item placed on the partition member 90 does not fall down because a front height of the partition member 90 is higher than a rear height thereof.

In order to enhance a supporting force, the recess coupling protrusion 92 may be formed in plurality in number so as to be spaced from each other with a certain distance therebetween.

The operation of the reserving apparatus of the refrigerator 1 according to the third embodiment of the present invention will be explained.

When the recess coupling protrusion 92 is coupled to the base recess 83, the partition member 90 horizontally partitions the inside of the supplementary reserving chamber 81. Here, the rotation protrusion 93 is in an inserted state into the rotating recess 87.

Then, the recess coupling protrusion 92 is separated from the base recess 83 by an external force, thus to be inserted into the inclination recess 85. While the recess coupling protrusion 92 moves, the rotation protrusion 93 serves as a rotation center of the partition member 90 while being rotated in the rotating recess 87.

Once the recess coupling protrusion 92 is inserted into the inclination recess 85, the partition member 90 partitions the inside of the supplementary reserving chamber 81 in an inclined manner.

The recess coupling protrusion 92 disposed in the inclination recess 85 is moved towards the base recess 83 by undergoing the above process.

According to the above configuration, the inside of the supplementary reserving chamber 81 can be partitioned into a horizontal multi-stage or an inclined multi-stage, thereby enhancing spatial utilization degree.

In the reserving apparatus of a refrigerator according to one aspect of the present invention, the inner space of the supplementary reserving chamber of the refrigerator can be effectively utilized, thereby having an enhanced industrial applicability.

The reserving apparatus of a refrigerator according to the present invention has the following advantages.

Owing to the partition member configured to variably partition the supplementary reserving chamber, the supplementary reserving chamber can be easily partitioned according to the kind of storage items. Storage items having various sizes and forms, such as a storage item having a relatively large size and a storage item having a relatively small size, can be effectively reserved at a suitably-adjusted space in the supplementary reserving chamber. Accordingly, the supplementary reserving chamber can have enhanced spatial utilization degree.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A refrigerator having a case that forms a main reserving chamber, and a door that opens and closes the main reserving chamber, the refrigerator comprising:

a rack disposed at the door; and a connecting portion configured to rotatably and slidably dispose the rack in the door between a first position where the rack is horizontally disposed to support objects and a second position where the rack is vertically disposed not to support objects, wherein the connecting portion comprises:

a rotation protrusion and a guide protrusion formed on both side surfaces of the rack with a spacing distance therebetween;

a rotation groove in which the rotation protrusion is rotatably inserted;

a slide guide groove in which the guide protrusion is slidably inserted; and a rotation guide groove in which the guide protrusion is inserted to guide rotation motion of the rack, wherein the guide protrusion is provided at least two in number, and wherein the rotation guide groove is provided in plurality, the plurality of rotation guide grooves formed respectively on a circumference with a preset diameter based on the rotation groove.

2. The refrigerator of claim 1, wherein the slide guide groove and the rotation guide groove are connected to each other.

3. The refrigerator of claim 2, wherein the slide guide groove is connected to one end of the rotation guide groove.

4. The refrigerator of claim 3, wherein when the guide protrusion is positioned in the slide guide groove, rotation motion of the rack is prevented.

5. The refrigerator of claim 1, wherein an aligning portion for aligning objects to be kept is formed at the rack.

6. The refrigerator of claim 5, wherein the aligning portion comprises receiving recesses formed on a surface of the rack.

7. The refrigerator of claim 1, wherein when the rack is in the second position, a free end of the rack is more adjacent to the door than in the first position.

8. A refrigerator having a case that forms a main reserving chamber, and a door that opens and closes the main reserving chamber, the refrigerator comprising:

a supplementary frame disposed at the door;

a rack disposed at the supplementary frame; and a connecting portion configured to rotatably and slidably dispose the rack in the supplementary frame between a first position where the rack is horizontally disposed to support objects and a second position where the rack is vertically disposed not to support objects;

wherein the connecting portion comprises:

a rotation protrusion and a guide protrusion formed on both side surfaces of the rack with a spacing distance therebetween;

a rotation groove in which the rotation protrusion is rotatably inserted, the rotation groove formed at the supplementary frame;

a slide guide groove in which the guide protrusion is slidably inserted, the slide guide groove formed at the supplementary frame; and a rotation guide groove in which the guide protrusion is inserted to guide rotation motion of the rack, the rotation guide groove formed at the supplementary frame, wherein the guide protrusion is provided at least two in number, and wherein the rotation guide groove is provided in plurality, the plurality of rotation guide grooves are formed respectively on a circumference with a preset diameter based on the rotation groove.

9. The refrigerator of claim 8, wherein the slide guide groove and the rotation guide groove are connected to each other.

10. The refrigerator of claim 9, wherein the slide guide groove is connected to one end of the rotation guide groove.

11. The refrigerator of claim 10, wherein when the guide protrusion is positioned in the slide guide groove, rotation motion of the rack is prevented.

12. The refrigerator of claim 11, wherein an aligning portion for aligning objects to be kept is formed at the rack.

13. The refrigerator of claim 12, wherein the aligning portion comprises receiving recesses formed on a surface of the rack.

14. The refrigerator of claim 8, wherein when the rack is in the second position, a free end of the rack is more adjacent to the supplementary frame than in the first position.

* * * * *